US008313126B2

(12) United States Patent
Ferkovich et al.

(10) Patent No.: US 8,313,126 B2
(45) Date of Patent: Nov. 20, 2012

(54) GRAVITY RELEASE LOCKING APPARATUS FOR TRASH CONTAINER

(75) Inventors: Robert W. Ferkovich, San Diego, CA (US); Anthony A. Hodge, San Diego, CA (US)

(73) Assignee: Hodge Products, Inc., El Cajon, CA (US)

( * ) Notice: Subject to any disclaimer, the term of this patent is extended or adjusted under 35 U.S.C. 154(b) by 969 days.

(21) Appl. No.: 12/256,776

(22) Filed: Oct. 23, 2008

(65) Prior Publication Data

US 2010/0102575 A1 Apr. 29, 2010

(51) Int. Cl.

| | |
|---|---|
| ***E05C 3/12*** | (2006.01) |
| ***E05C 3/06*** | (2006.01) |
| ***E05C 19/10*** | (2006.01) |
| ***E05C 1/02*** | (2006.01) |
| ***E05C 19/12*** | (2006.01) |

(52) U.S. Cl. ..... 292/230; 292/231; 292/130; 292/183; 292/11

(58) Field of Classification Search ..... 292/230, 292/231, 232, 236, 130, 183, 11, 29, 52
See application file for complete search history.

(56) References Cited

U.S. PATENT DOCUMENTS

| | | | | |
|---|---|---|---|---|
| 3,011,666 | A | 12/1961 | Dempster et al. | |
| 3,315,828 | A | 4/1967 | Dubo | |
| 3,687,317 | A | 8/1972 | Gagel | |
| 3,709,389 | A | 1/1973 | Steltz | |
| 4,155,584 | A * | 5/1979 | Pracchia | 294/68.26 |
| 4,182,530 | A * | 1/1980 | Hodge | 294/68.26 |
| 4,183,295 | A * | 1/1980 | Peterson | 100/345 |
| 4,198,087 | A | 4/1980 | Cornell et al. | |
| 4,424,740 | A | 1/1984 | Gwathney | |
| 4,520,945 | A | 6/1985 | Hodge | |
| 4,581,907 | A * | 4/1986 | Eberly | 70/54 |
| 4,756,562 | A * | 7/1988 | Foster et al. | 292/28 |
| 4,852,920 | A * | 8/1989 | DeForrest, Sr. | 292/205 |
| 4,955,501 | A | 9/1990 | Hodge | |
| 5,015,021 | A | 5/1991 | Wyson et al. | |
| 5,025,721 | A | 6/1991 | Spiers | |
| 5,029,724 | A | 7/1991 | Serio | |
| 5,042,856 | A | 8/1991 | Goodman | |
| 5,085,341 | A * | 2/1992 | Hodge | 220/811 |

(Continued)

OTHER PUBLICATIONS

Advertisement for Auto Lock by Laser Precise®, Inc., Nov. 2007.

*Primary Examiner* — Thomas Beach
*Assistant Examiner* — Nathan Cumar
(74) *Attorney, Agent, or Firm* — Procopio Cory Hargreaves & Savitch LLP

(57) ABSTRACT

A trash container locking apparatus includes a housing which is secured to a surface of a trash container. The housing includes a pivot member rotatably mounted in an outer wall of the housing for rotation about a pivot axis and having an inner portion inside the housing and an outer portion outside the housing. A latch member is secured to the pivot member inside the housing. A swing arm secured to the pivot member outside the housing and associated with a locking bar which extends over a lid of the trash container. A latch paddle is pivotally mounted in the housing to hang vertically in a latch engaging position when the housing is mounted on the trash container. The latch member and latch paddle have interengaging formations which engage in a locking position to prevent the latch member and associated swing arm from rotating.

13 Claims, 13 Drawing Sheets

U.S. PATENT DOCUMENTS 5,090,753 A 2/1992 Goodman
5,094,358 A 3/1992 Serio, Sr.
5,094,487 A 3/1992 Drewry
5,118,000 A * 6/1992 Howell et al. ..... 220/315
5,135,129 A 8/1992 Joly
5,149,153 A * 9/1992 Drewry et al. ..... 292/104
5,201,434 A 4/1993 DeVivo
5,213,382 A 5/1993 Dawdy
5,224,743 A 7/1993 Dawdy et al.
5,224,744 A 7/1993 Michelutti
5,415,314 A * 5/1995 McCollum ..... 220/315
5,419,598 A 5/1995 Kreitzer
5,474,341 A 12/1995 Putman
5,599,050 A 2/1997 Tinsley
5,662,364 A 9/1997 Reeb et al.
5,683,126 A 11/1997 De Vivo et al.
5,738,395 A 4/1998 Probst
5,772,061 A 6/1998 Lowe
5,772,264 A 6/1998 Bettenhausen
5,997,052 A 12/1999 Reeb et al.
6,267,260 B1 7/2001 Lyons
6,290,093 B1 9/2001 Obriot et al.
6,733,053 B2 5/2004 Hodge et al.
7,597,365 B2 * 10/2009 Kreitzer ..... 292/148
2002/0078720 A1 6/2002 Watts

* cited by examiner

GRAVITY RELEASE LOCKING APPARATUS FOR TRASH CONTAINER

BACKGROUND

1. Field of the Invention

The present invention relates to a trash container locking apparatus and method for releasably locking a trash bin lid in a closed position while allowing the lock to release under gravity to allow the lid to open automatically when the container is inverted by a trash truck during a dumping operation.

2. Related Art

Owners of large size or commercial trash bins as used for businesses, stores, apartments, and the like often experience difficulty in preventing unauthorized use of the bins. Waste disposal costs are increased by unauthorized individuals dumping trash into the bins. In view of this, various locking systems have been proposed in the past for preventing dumping of trash in such bins by unauthorized individuals. However, such locking systems often make it difficult for authorized users to gain access to the bin, and also cause difficulty to refuse collectors.

Some trash bins have automatic locks which release when the bin is inverted to dump trash. U.S. Pat. No. 5,213,382 of Dawdy et al. describes a locking mechanism for a refuse container which has a locking bar pivotally attached to the container and movable between a locked position preventing opening of the container lid and an open position in which it is rotated out of the way of the lid. When a locking fixture on the mechanism is engaged, the locking bar cannot be manually pivoted, but it can be pivoted by the force of a collection truck boom. The lock may be disengaged by a key allowing manual pivoting of the locking bar into the open position.

Other trash bin locking systems are known which involve a bar pivotally mounted on the container and rotatable between a position extending over the lid to hold it closed, and a position rotated down against the front wall of the container, leaving the lid free to open. The bar is normally locked by a padlock or the like in the closed position. Some prior art trash container locking systems which have an automatic gravity release are quite complex, with many interengaging lock parts including springs, sliding balls, levers, triggers, and the like, and are therefore subject to potential malfunction.

In our prior U.S. Pat. No. 6,733,053, a trash container locking apparatus is described in which a locking arm is configured to extend across the width of a trash container adjacent the upper, front end of the container, and has bent end portions pivotally mounted on opposite sides of the container. This allows the arm to be pivoted between a first position extending over the closed lid of the container to hold it closed, and a second position extending across the front of the container so that the lid can be freely opened. The arm is lockable in both the first and second position by means of spaced locking plates on one side wall of the container which are positioned for engagement with locking flanges on the bent end portion of the locking arm when the arm is in the first and second position, respectively.

SUMMARY

Embodiments described herein provide for a gravity release locking apparatus for a trash container.

According to one embodiment, a trash container locking apparatus comprises a housing which is secured to a surface of a trash container, the housing having an outer wall, a pivot member rotatably mounted in the outer wall for rotation about a pivot axis and having an inner portion inside the housing and an outer portion outside the housing, a latch member secured to the pivot member inside the housing, and a swing arm secured to the pivot member outside the housing and associated with a locking bar which extends over the closed lid of a trash container in the operative position and is rotated away from the lid to allow the lid to open in a released position, the latch member and swing arm being rotatable with the pivot member about the pivot axis between a first position corresponding to the operative position of the locking arm and a second position corresponding to the released position of the locking arm. A latch plate or paddle is pivotally mounted in the housing to hang vertically in a latch engaging position when the housing is mounted on a trash container in an upright position. The latch member and latch paddle have interengaging formations which engage in a locking position corresponding to the operative position of the locking arm, to prevent the latch member and associated swing arm from rotating. The latch paddle is positioned to swing away from the latch member and release it under gravity when the trash container to which it is attached is inverted to dump trash from the container, which in turn allows the locking arm to rotate out of the way of the lid, into the released position. A lockable cam lever is rotatable by an authorized user to rotate the latch paddle away from the latch member when the user wishes to open the trash container in an upright position, in order to deposit trash in the container.

In one embodiment, the cam lever may be associated with a keyed lock mechanism, where the user turns the key in order to simultaneously rotate the cam lever attached to the key cylinder inside the housing. In another embodiment, the cam lever is associated with a pivot or operating lever which extends outside the housing and which can be secured to a fixed locking flange on the outside of the housing by a padlock having a hasp extending through aligned openings in the flange and pivot lever when the cam lever is in an inoperative position spaced from the pivot lever. When the padlock is removed, the user can rotate the pivot lever so as to move the cam lever to release the latch member and allow the locking arm to be rotated.

The operating pivot lever and the cam lever may comprise a single pivoted member which extends from the outside of the housing through a slot on a side of the housing to the interior of the housing, the slot configured to accommodate a rotation of the operating lever, the operating lever configured to rotate the latch paddle away from the latch member to allow the swing arm and the associated locking bar to rotate away from the lid to allow the lid to be opened when the trash container is in an upright position. Alternatively, the cam and pivot levers may be separate members secured together by a pivot extending through an opening in a wall of the lock housing.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an apparatus and method for locking a trash container with the lid in the closed position.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
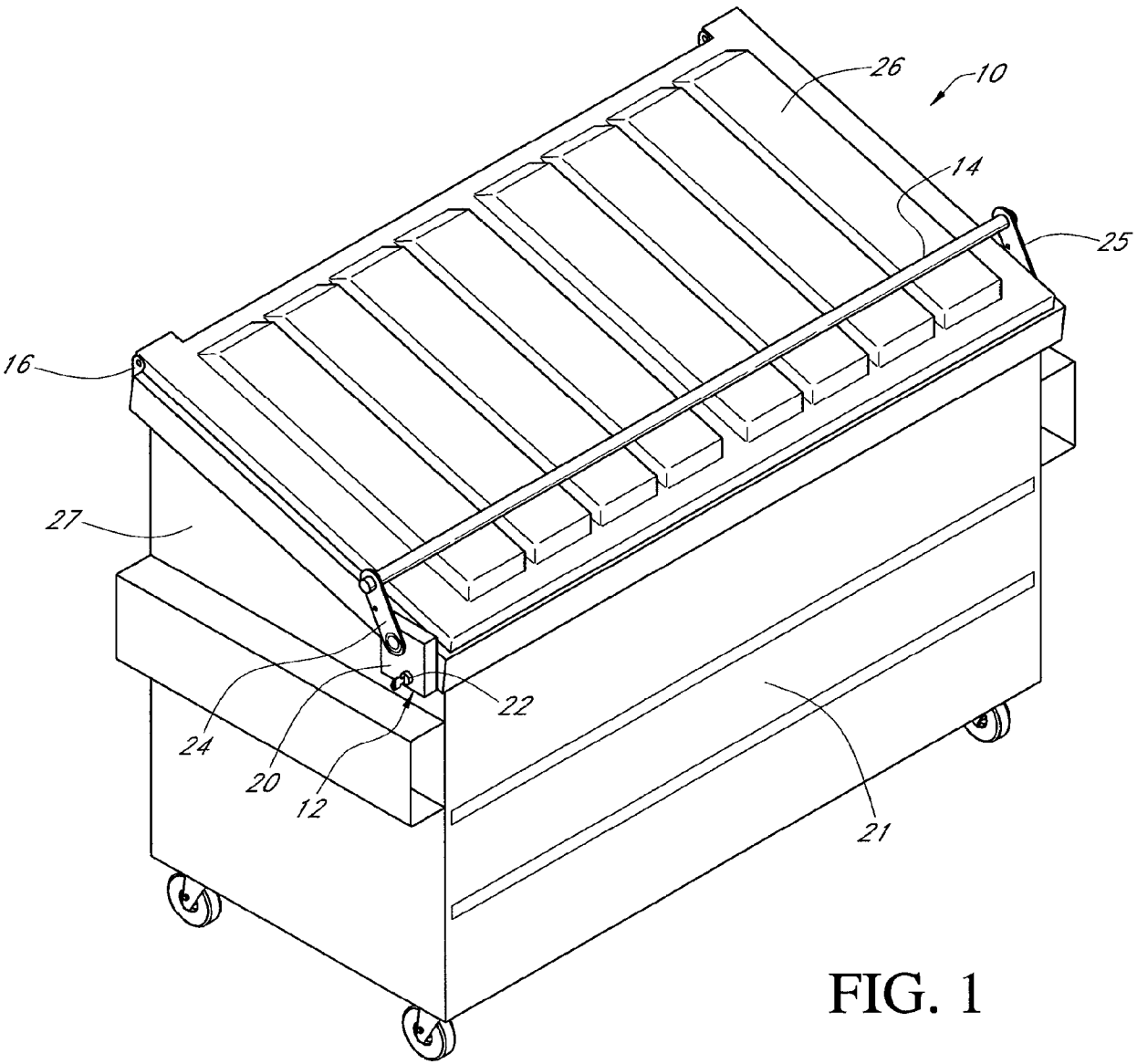
FIG. 1 illustrates an isometric frontal view of one embodiment of a trash container with a trash container locking apparatus and a locking bar in the unreleased or operative position.
Figure 2:
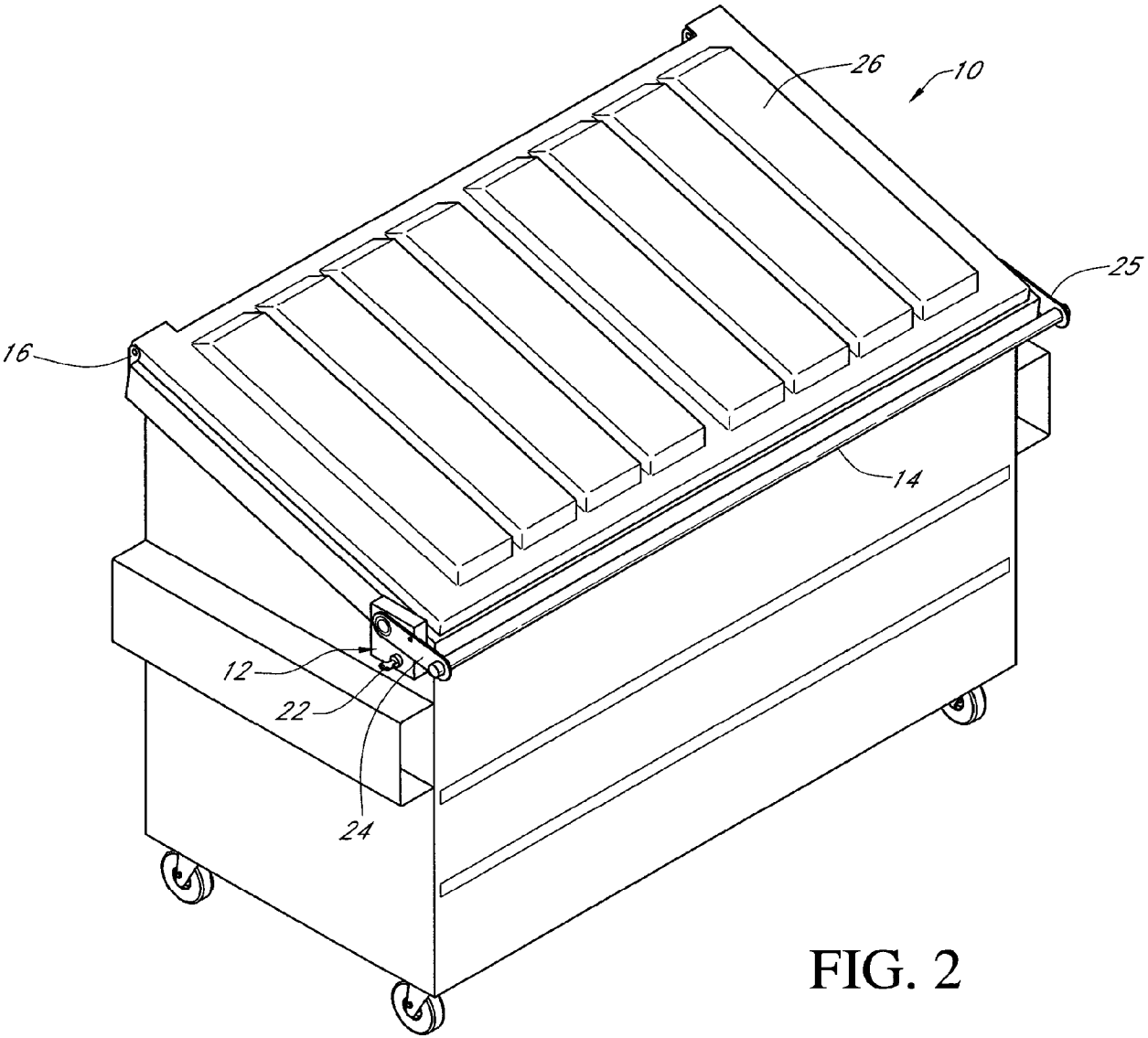
FIG. 2 illustrates a second view of the trash container of FIG. 1 with a locking bar in the released or open position.

FIGS. 1 and 2 illustrate an isometric frontal view of a trash container 10 in an upright condition with a trash container locking apparatus 12 according to one embodiment mounted on a side wall of the container. The trash container locking apparatus 12 serves as a locking mechanism for the trash container 10. Although the trash container locking apparatus 12 is described in the context of a trash container 10, it can also be applied to other containers such as those that can be emptied by inversion. The trash container 10 includes at least one lid 26 shown in the closed position and a locking bar 14 which prevents lid 26 from opening. Lid 26 pivots about pivot 16 in order to allow the lid 26 to be opened in a pivoting movement. Multiple lids 26 may be provided on larger trash containers, as is known in the field.

Figure 3:
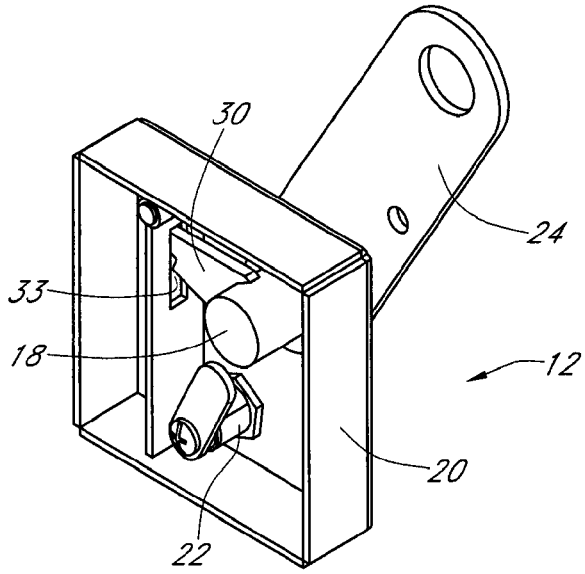
FIG. 3 illustrates the trash container locking apparatus when the trash container is in an upright position and the locking bar is in the position of FIG. 1.
Figure 4:
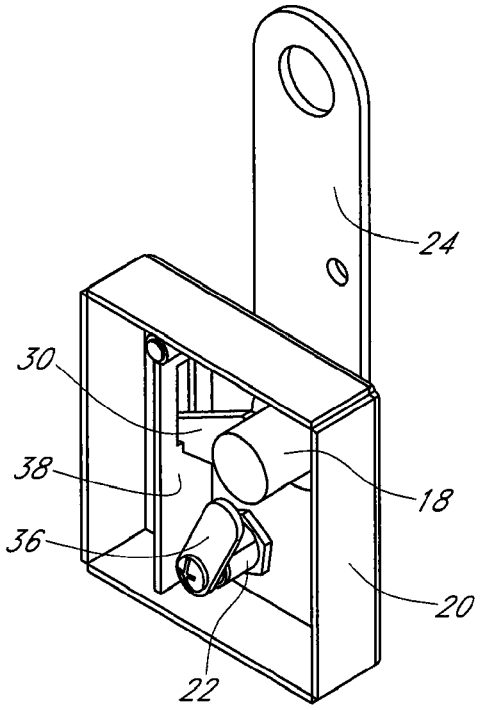
FIG. 4 illustrates the trash container locking apparatus of FIG. 3 with the swing arm rotated upward from the position of FIG. 3 so that the latch member is rotated toward the latch.
Figure 5:
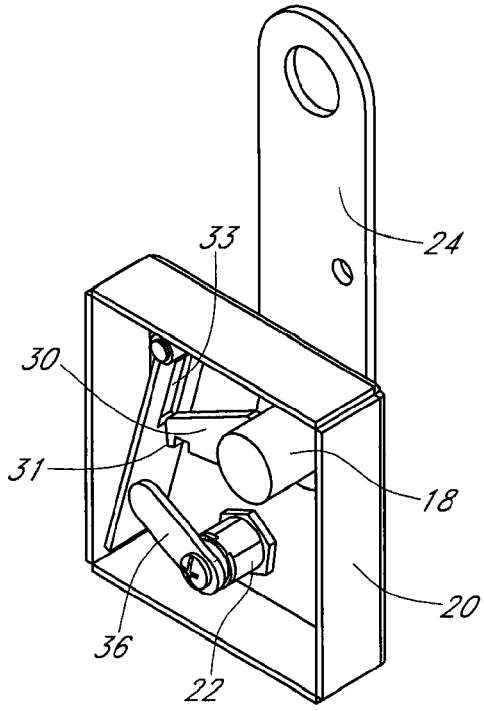
FIG. 5 illustrates of the trash container locking apparatus of FIG. 3 with the cam lever unlocked and rotated to release the latch.

Locking bar 14 is attached to swing arms 24, 25 at each end which are pivoted to the sidewalls 27 at opposite ends of the container such that the locking bar 14 extends over the closed lid 26 in the operative or unreleased position (FIG. 1) or is rotated away from the lid 26 to allow the lid 26 to open in a released or unlocked position (FIG. 2). The swing arm 24 at one end is secured to a pivot member or pin 18 which extends into housing 20, as illustrated in FIGS. 3 to 5. The pivot pin 18 extends from the outside of the housing to the inside of the housing. The locking bar 14 extends over lid 26 in the locked position to prevent opening of the lid by unauthorized individuals, as illustrated in FIG. 1. When released, the pivot pin 18 allows the locking bar 14 to be moved out of the path of the lid 26, in the released position as illustrated in FIG. 2.

The trash container locking apparatus 12 has an outer housing 20 which is positioned on side wall 27 of the trash container 10 as illustrated in FIGS. 1 and 2. A keyed lock mechanism 22 is also positioned on the outer portion of the housing 20 to unlock the locking bar 14 in order to allow manual movement of the locking bar 14 into the released position as best illustrated in FIG. 2. With this arrangement, access to the trash container 10 is simplified to enable access into the trash container 10 by authorized users.

FIG. 3-5 illustrate the trash container locking apparatus 12 when the trash container is in the upright or rest position. The housing 20 includes outer wall 28 and the swing arm 24 which is rotatably mounted in the outer wall for rotation about a pivot axis via a rotatably mounted pivot pin 18 which extends through an opening in the outer wall into the housing. The trash container locking apparatus 12 also includes a latch member 30 secured to the pivot pin 18 inside the housing. The swing arm 24 is secured to the pivot pin 18 outside the housing and associated with the locking arm 14 which extends over the closed lid 26 of the trash container 10 in the operative position and is rotated away from the lid 26 to allow the lid 26 to open in the released position of FIG. 2. When released, the latch member 30 and swing arm 24 are rotatable with the pivot pin 18 about the pivot axis between a first position corresponding to the operative position of the locking arm 14 and a second position corresponding to the released position of the locking arm 14.

A latch plate or paddle 38 is pivotally mounted in the housing to hang vertically in a latch engaging position (see FIG. 3) when the housing is mounted on a trash container 10 in an upright position. As illustrated in FIG. 3, the latch member 30 and latch paddle 38 have interengaging formations 31, 33 which engage in a locking position corresponding to the operative position of the locking arm 14, to prevent the latch member 30 and associated swing arm 24 from rotating. Latch member has hook 31 at its free end which engages in opening 33 in the latch paddle 38 in the locked position of FIGS. 3 and 4. A cam lever or projecting arm 36 is associated with the lock cylinder 22 to rotate between positions of FIGS. 4 and 5 as a key inserted in the lock is rotated by an authorized user. The end of the cam lever or projecting arm 36 engages the latch paddle 38 to rotate it away from the latch member 30 when the user wishes to open the trash container 10 in an upright position, in order to deposit trash in the trash container 10. This rotation is illustrated best in FIGS. 3-5 where the projecting or cam lever arm 36 is rotated from its inoperative position in FIG. 3 to the operative position in FIG. 5. In the operative position, the cam lever 36 has rotated the latch paddle 38 away from the latch member 30 to enable manual rotation of the locking bar 14 and swing arm away from the lid, as illustrated in FIGS. 6A to 6C.

Figure 6A:
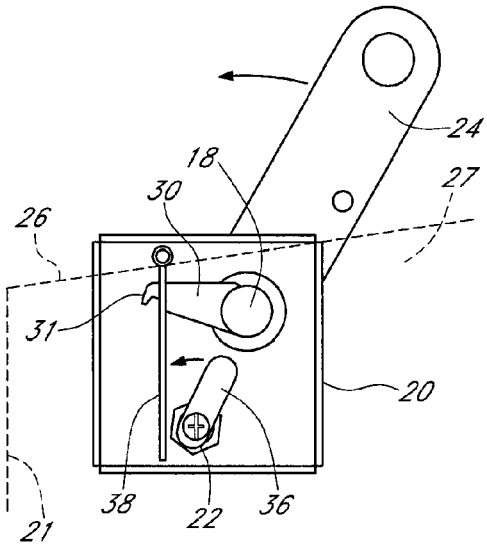
FIGS. 6A-6C illustrate the trash container locking apparatus of FIG. 3 showing the release of the latch member from the latch paddle due to the rotation of the cam lever with the trash container in the upright or rest position.
Figure 6B:
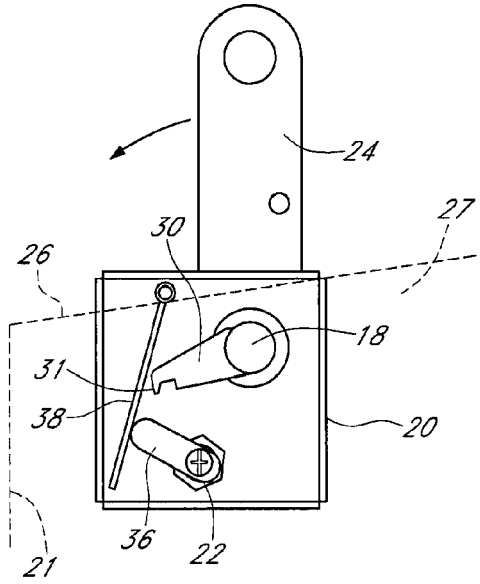
Figure 6C:
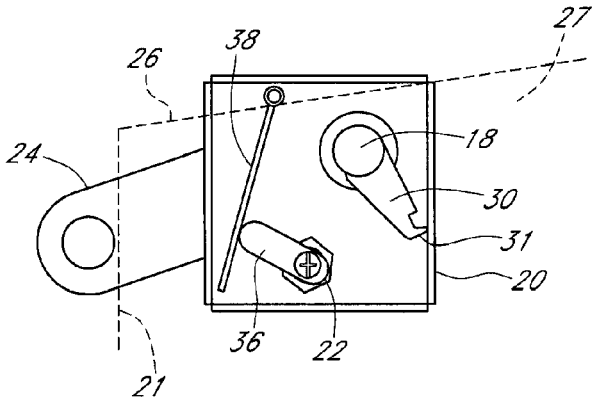

FIG. 6A-6C illustrate the actuation/unlocking of the trash container locking apparatus of FIG. 3 using a key when the trash container is in the upright position. Cam lever or projecting arm 36 is associated with the lock cylinder 22 to rotate between positions of FIGS. 4 and 5 as a key inserted in the lock is rotated by an authorized user. FIG. 6A illustrates the start position before the cam lever 36 begins its rotation. In this position, swing arm 24 is in the operative position of FIGS. 1 and 3. If an unauthorized person attempts to rotate the locking bar 14 forward from this position, the hooked end 31 engages firmly in the opening 33 when the swing arm reaches the position of FIG. 4, and no further rotation is permitted. An authorized individual leaves swing arm 24 in the start position of FIGS. 3 and 6A, then rotates a key in lock 22, so that the end of the cam lever or projecting arm 36 engages the latch paddle 38 to rotate it away from the latch member 30. In FIG. 6B, which corresponds to the position of FIG. 5, the latch paddle 38 is released from the latch member 30, simultaneously releasing the locking bar 14 and the swing arm so they can be rotated forward due to the manual movement into the released position. In the released position, the cam lever or projecting arm 36 has rotated the latch paddle 38 away from the latch member 30 to enable manual rotation of the locking bar 14 and swing arm 24. The locking bar 14 and swing arm are rotated forward from the position of FIG. 6B into the released position as illustrated by FIG. 6C, while the latch paddle 38 is still engaging the cam lever 36. After trash is dumped in the container, the locking bar 14 can then be manually rotated or moved back to the unreleased position where the locking bar 14 extends over lid 26. As the locking bar is rotated back to extend over the lid, it rotates the latch member 30 into position to re-engage the opening 33. Re-locking with a key then rotates cam lever 36 away from the paddle 38, which drops back to the vertical position to re-engage latch member 30.

FIGS. 7A-7D illustrate of the gravity release of the trash container locking apparatus 12 when the trash container is lifted from the upright or rest position to an inverted position. FIG. 7E illustrates the trash container locking apparatus 12 when the trash container 10 is returned to its upright or rest position after trash has been dumped from the trash container 10.

Figure 7A:
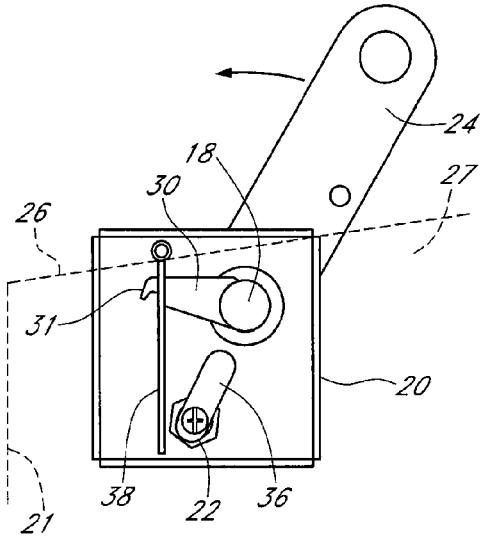
FIGS. 7A-7D illustrate rotation of the trash container locking apparatus of FIG. 3 as the trash container is inverted to dump trash, illustrating gravity release of the latch.
Figure 7B:
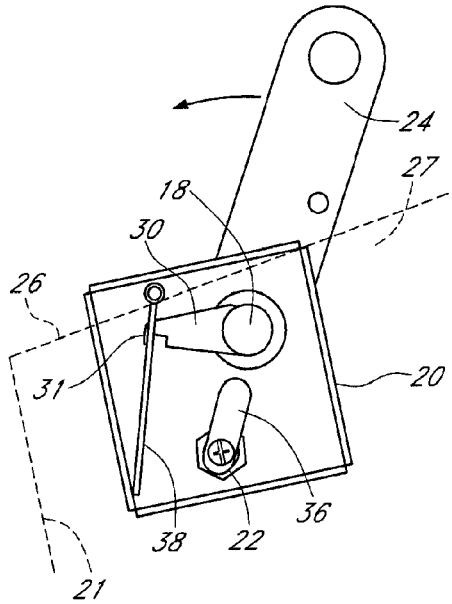
Figure 7C:
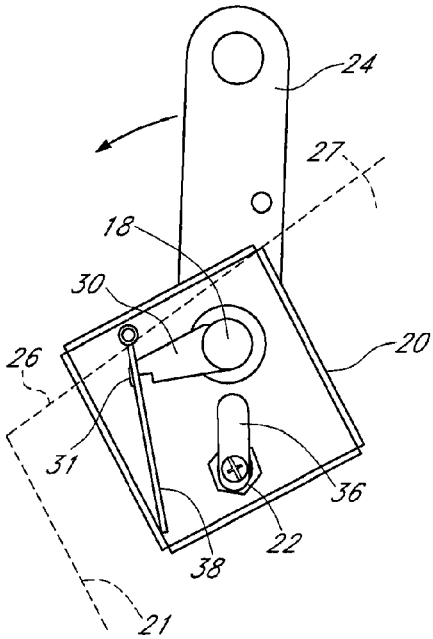
Figure 7D:
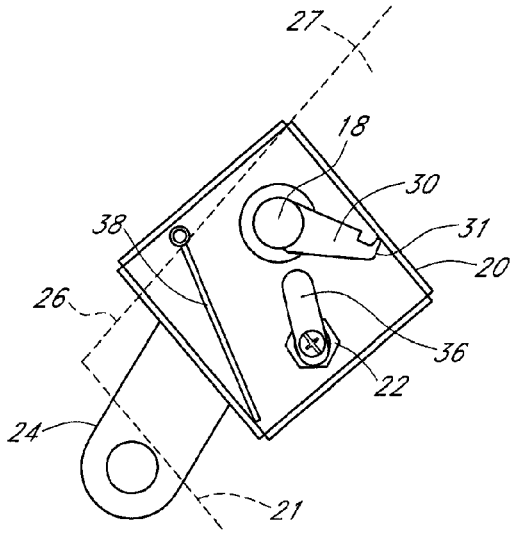
Figure 7E:
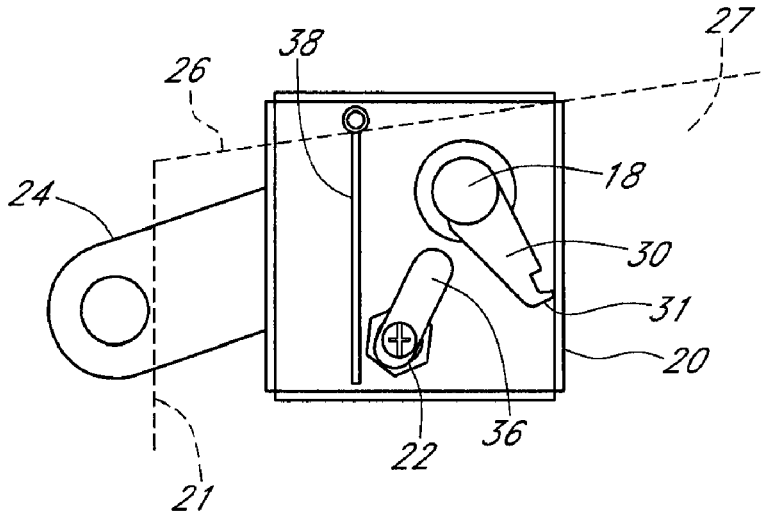
FIG. 7E illustrates the position of the latch components when the trash container is returned to its upright or rest position.

The latch paddle 38 is positioned to swing away from the latch member 30 under gravity and release it when the trash container to which it is attached is inverted to dump trash from the trash container 10, which in turn allows the locking bar 14 to rotate out of the way of the lid, into the released position, as illustrated in FIGS. 7A to 7D. FIG. 7A illustrates the start position. In the start position, the latch paddle 38 is in a vertical orientation corresponding to the trash container 10 in the upright position. When a trash container 10 is to be emptied, a garbage truck, for example, swings the trash container over the cab of the garbage truck in the inverted or upside down position above the garbage truck. As the trash truck starts to rotate the trash container 10 (FIG. 7B), the latch paddle 38 starts to tilt away from the latch member due to gravitational force. As the trash truck continues to invert the trash container 10, the swing arm 24 is moved under gravity to a maximum position where the latch member 30 and the latch paddle 38 are still engaged (FIG. 7C). The latch paddle 38 is eventually released from the latch member 30, simultaneously releasing the locking bar or locking arm 14 and swing arm 24 so they are free to pivot forward under gravity into the released position (FIG. 7D). This also rotates the latch member 30 attached to the swing arm 24 away from the latch paddle 38, as illustrated in FIG. 7D. Rotation of the locking bar away from the lid 26 allows the lid 26 in turn to open under gravity as it is inverted. When the trash container 10 is returned to its upright or rest position, the locking bar 14 remains in the released position as illustrated by FIG. 7E, while the latch paddle 38 returns to the vertical position. The locking bar 14 can then be manually rotated or moved to the unreleased position where the locking bar 14 extends over the at least one closed lid 26 in the operative or unreleased position. As the locking bar is rotated, it simultaneously rotates the latch member 30 to re-engage the opening 33 in paddle 38.

In the embodiment of FIGS. 1 to 7, the cam lever arm 36 is associated with a keyed lock mechanism 22, where a user turns a key 11 in order to simultaneously rotate the cam lever 22 attached to the rotatable base of key cylinder 22 inside the housing 20. FIGS. 8-13 illustrate an alternative embodiment of the trash container locking apparatus 12 in which a cam lever 85 inside the housing is associated with a manually operable pivot lever 82 and a fixed locking flange 84 on the lower wall of housing 20. The latch member 130 in FIG. 8 onwards may be replaced by the latch member 30 of the first embodiment illustrated in FIGS. 1-7, which has a hooked end 31 of slightly different shape and dimensions.

Figure 8:
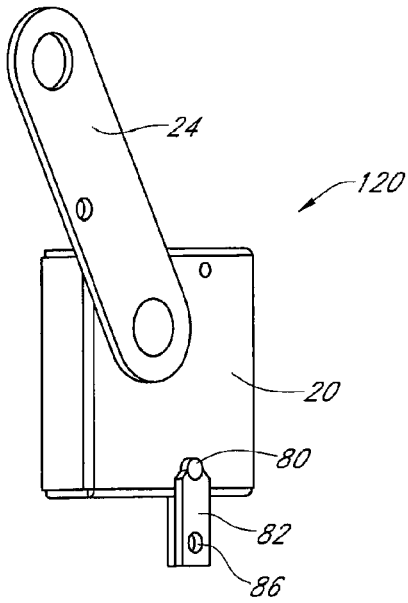
FIG. 8 illustrates another embodiment of a trash container locking apparatus which uses a padlock to lock a latch release lever against manual release of the trash container locking bar.
Figure 9:
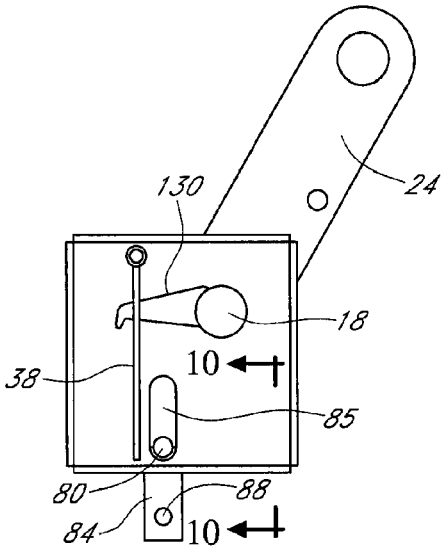
FIG. 9 illustrates an inner portion of the trash container locking apparatus of FIG. 8.
Figure 10:
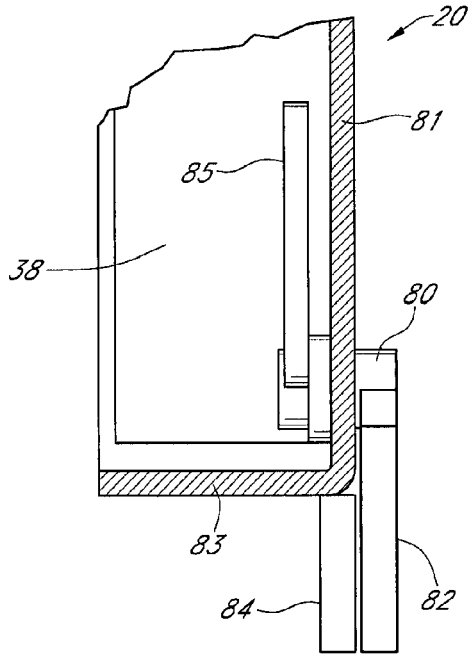
FIG. 10 illustrates a sectional view of the trash container locking apparatus on lines 10-10 of FIG. 9, illustrating the cam lever and fixed locking flange.
Figure 11:
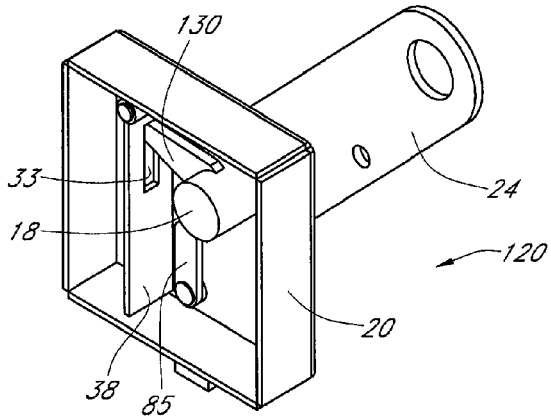
FIG. 11 illustrates the inner portion of the trash container locking apparatus of FIG. 9 in the operative position.
Figure 12A:
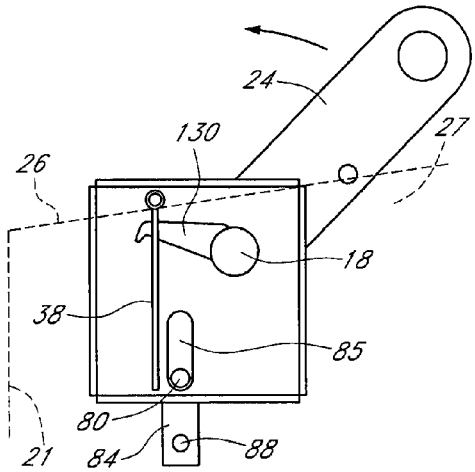
FIGS. 12A-12D illustrate the manual release of the latch member in the locking apparatus of FIGS. 9 to 11 by rotation of the pivot lever with the trash container in the upright or rest position.
Figure 12B:
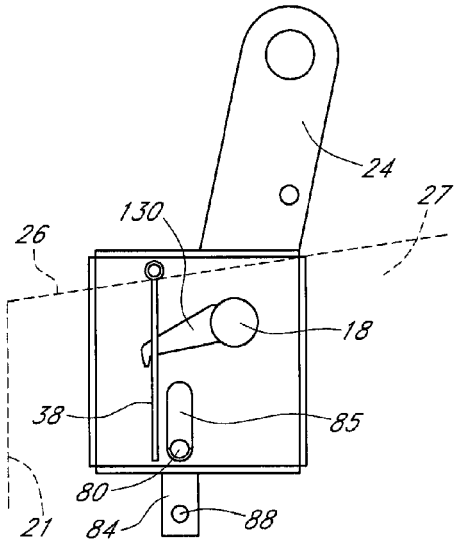
Figure 12C:
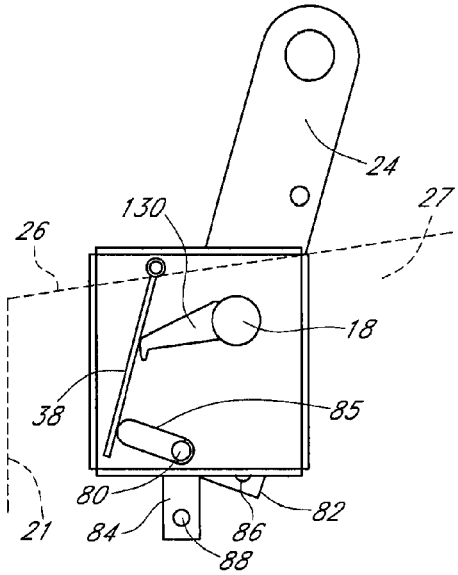
Figure 12D:
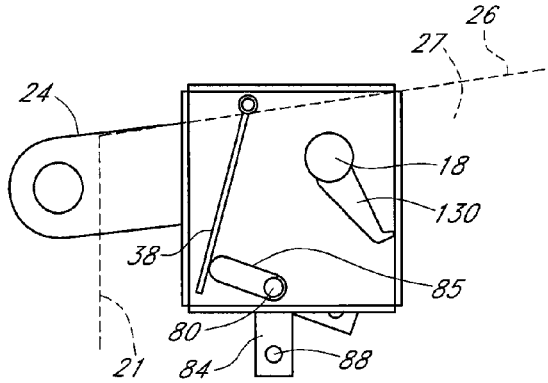
Figure 13A:
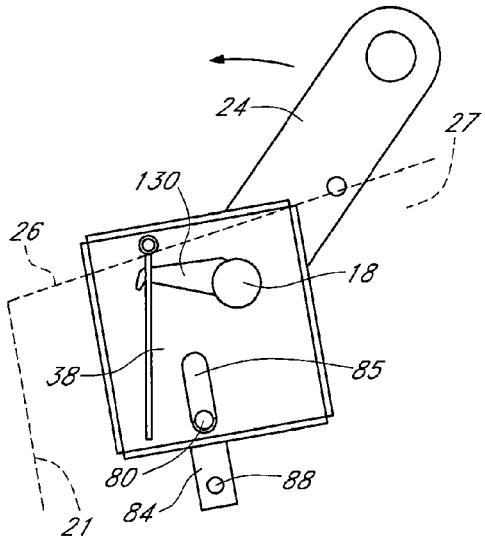
FIGS. 13A-13D illustrate gravitational release of the latch member in the locking apparatus of FIGS. 9 to 11 as the trash container is lifted from the upright or rest position to an inverted position.
Figure 13B:
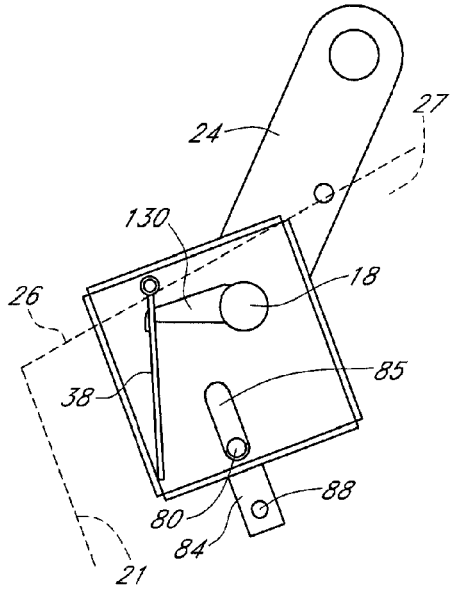
Figure 13C:
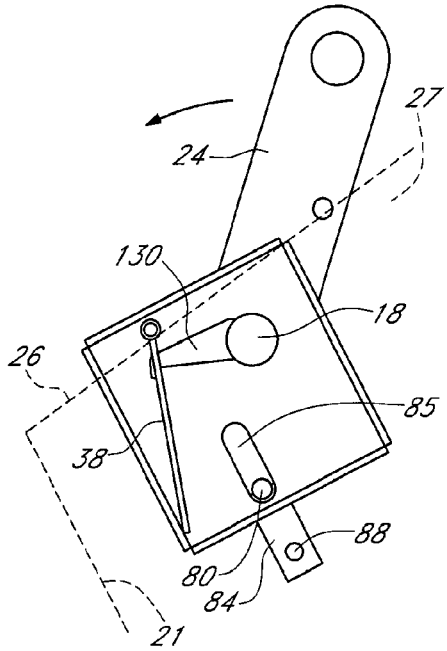
Figure 13D:
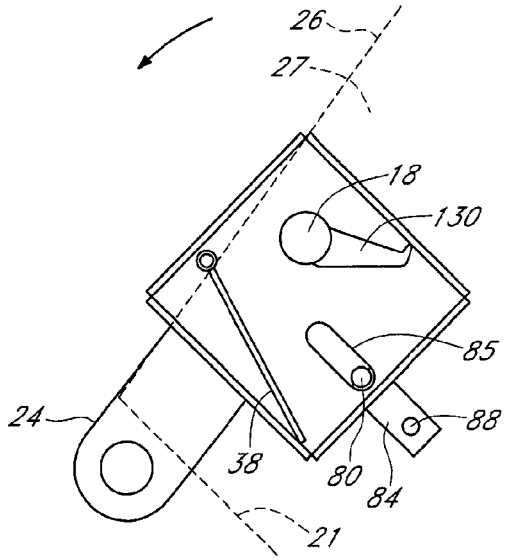
Figure 13E:
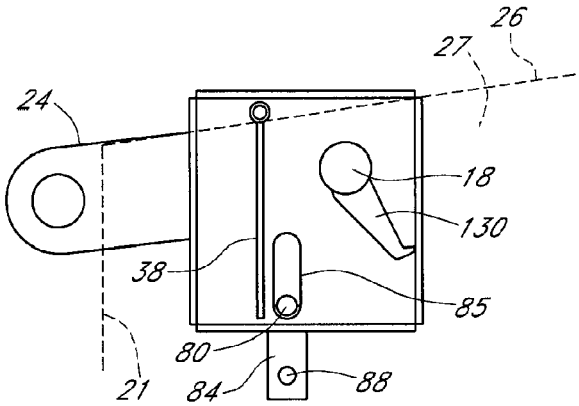
FIG. 13E illustrates the trash container locking apparatus when the trash container is returned to its upright or rest position after gravity release.
Figure 14:
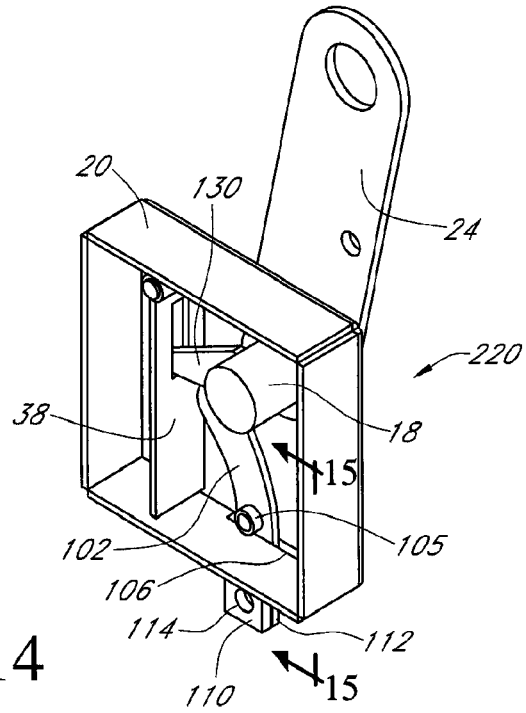
FIG. 14 illustrates another embodiment of the trash container locking apparatus having a fixed locking flange and an operating lever that projects into the inner portion of the trash container locking apparatus.

In the embodiment of FIGS. 8 to 13, the cam lever 85 is connected to the pivot lever 82 outside the housing 20 via pivot 80 which is rotatably engaged through an opening in wall 81. The pivot lever 82 can be secured to fixed locking flange 84 on the outside of the housing by a padlock having a hasp extending through aligned openings 86 in the fixed locking flange 84 and pivot lever 82 when the cam lever 85 is in an inoperative position and the locking bar extends over the lid or lids of the trash container with the attached swing arm 24 in the position of FIGS. 8-11, 12A and 12B. The pivot lever 82 is aligned with the fixed locking flange 84 in the inoperative position, as illustrated in FIGS. 8-10. When the padlock is removed, the user can rotate the pivot lever 82 so as to move the cam lever 85 from the position of FIG. 12A to a position of FIG. 12C, to release the latch member 130 from the latch paddle 38. This process releases swing arm 24 and allows the locking arm 14 to be rotated to the front of the trash container 10 as in FIG. 12D, so that lid 26 can be opened for accessing the interior of the trash container 10. In the illustration of FIGS. 13A-13E, when the trash container is inverted for dumping the contents of the trash container into a truck, the trash container locking apparatus 12 operates in substantially the same manner described above in connection with FIGS. 7A to 7E to release the locking bar 14. In this embodiment, when the trash container 10 is inverted, the pivot lever 82 stays secured to the fixed locking flange 84 by a padlock and the cam lever is held in the inoperative position. As illustrated in FIGS. 13A-13E, the latch paddle 38 rotates away from the latch member 130 under gravity as the container starts to be inverted. The resultant release of the latch member 130 and associated locking arm 14 is due to gravitational force caused by the inversion of the trash container 10, as discussed previously with respect to FIGS. 7A-7E.

Figure 15:
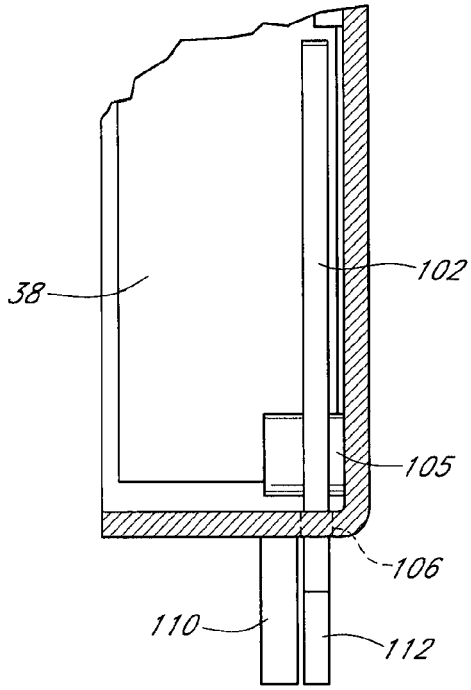
FIG. 15 illustrates a sectional view of part of the trash container locking apparatus on the lines 15-15 of FIG. 14.
Figure 16A:
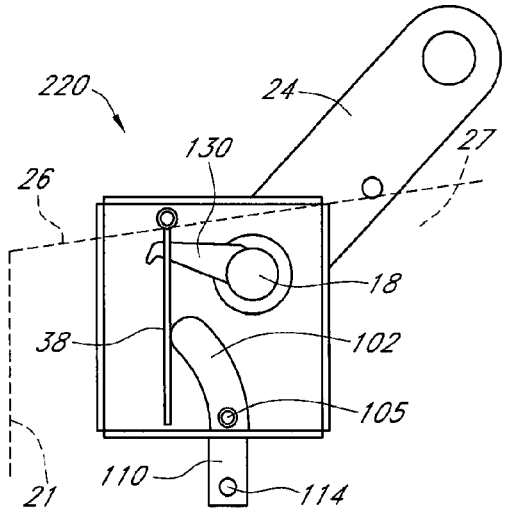
FIGS. 16A-16C illustrate the manual release of the trash container locking apparatus of FIGS. 14 and 15 with the trash container in the upright or rest position.
Figure 16B:
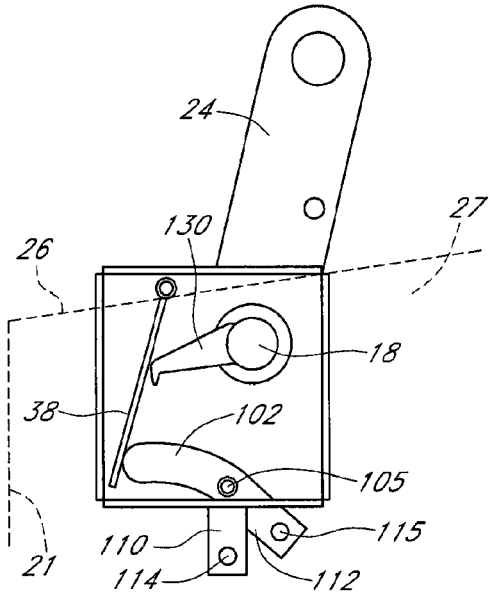
Figure 16C:
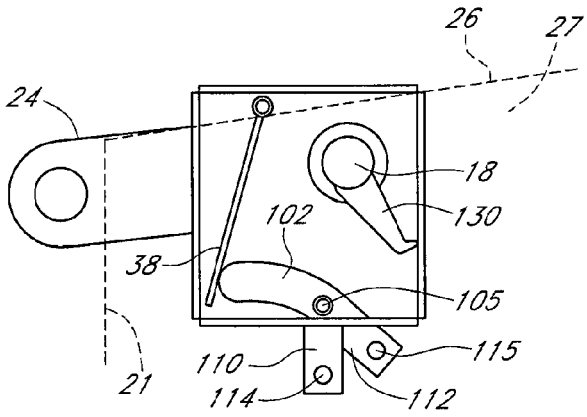

FIGS. 14-17 illustrate another embodiment of the trash container locking apparatus 12 which is similar to the embodiment of FIGS. 8 to 13, but replaces the cam lever 85 and pivot lever 82 with a single operating lever 102 extending out through slot 106 and pivoted to outer wall of housing via pivot 105. The slot is large enough to accommodate rotation of the operating lever 102. In one embodiment, the interior portion of operating lever 102 is substantially curved in the direction of the latch paddle 38 so that when the operating lever 102 is manually rotated toward the latch paddle 38, it moves the latch paddle 38 away from the latch member 130 to release the latch paddle 38 from the latch member 130. In the locked position of FIG. 16A, the inner portion of the operating lever 102 contacts the paddle 38 and the outer portion 112 of the operating lever 102 which extends outside the housing 20 is secured to a fixed locking flange 110 (similar to flange 84 in FIGS. 8-10 above) on the outside of the housing by a padlock having a hasp extending through aligned openings 114, 115 in the fixed locking flange 110 and operating lever 102. The operating lever 102 is spaced from the fixed locking flange 110 as illustrated in FIG. 15. When the padlock is removed, the user can rotate the outer portion 112 of operating lever 102 so as to rotate the interior portion of the operating lever and rotate the latch paddle 38 away from the latch member 130, subsequently releasing the latch member 130 from the latch paddle 38 as illustrated in FIG. 16B. Arm 24 is then free to rotate. This process allows the locking arm 14 to be rotated in front of the trash container as in FIG. 16C, so that the at least one lid 26 can be opened for accessing the interior of the trash container 10.

Figure 17A:
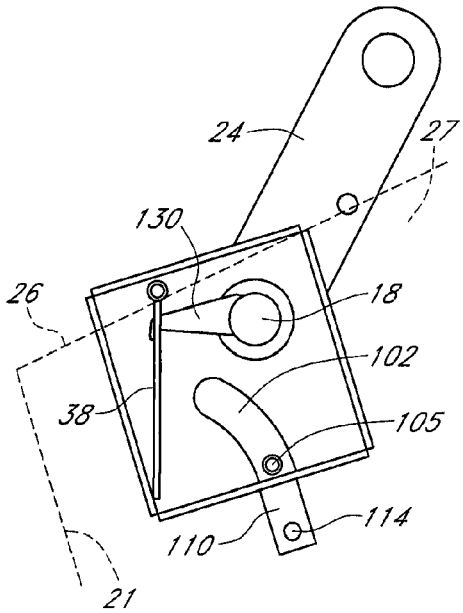
FIGS. 17A-17B illustrate gravity release of the trash container locking apparatus of FIGS. 14 and 15 when the trash container is lifted from the upright or rest position to an inverted position.
Figure 17B:
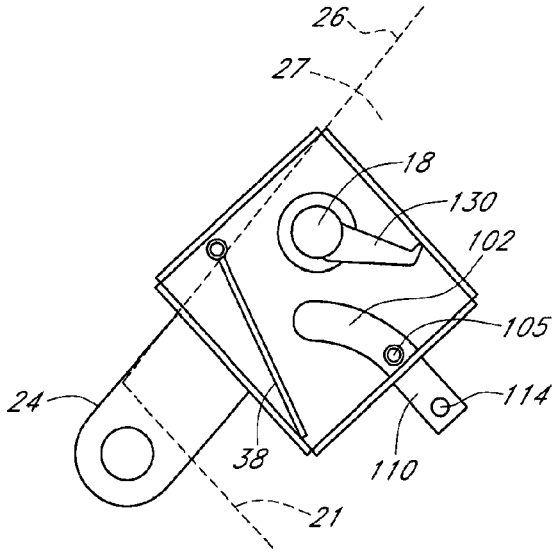
Figure 17C:
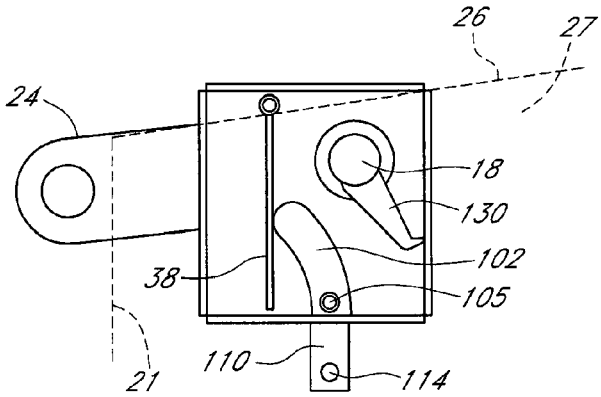
FIG. 17C illustrates the trash container locking apparatus of FIGS. 14 to 17B when the trash container is returned to its upright or rest position after gravity release of the latch.

In the illustration of FIGS. 17A-17C, when the trash container is inverted for dumping the contents of the trash container into a truck, the trash container locking apparatus 12 operates in substantially the same manner as that of the trash container locking apparatus 12 illustrated in FIGS. 13A-13E. In this embodiment, when the trash container 10 is inverted, the operating lever 102 stays secured to the fixed locking flange 110 in an inoperative position. Thus, as illustrated in FIGS. 17A-17C, the rotation of the latch member 130 and the pulling away of the latch paddle 38 from the latch member 130 is due to a gravitational force caused by the inversion of the trash container 10.

In each of the above embodiments, a trash container locking apparatus and method for releasably locking a trash bin lid in a closed position is described, which has a locking mechanism which releases under gravity to allow the lid to open automatically when the container is inverted by a trash truck during the dumping operation is described. The use of the trash container locking apparatus makes it easy for authorized users including refuse collectors to gain access to the trash container while deterring unauthorized users from dumping trash into the trash container.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A trash container locking apparatus comprising:

a housing mounted on a side surface of a trash container, the housing having an outer wall facing away from the side surface of the trash container, an upper wall, a lower wall, and opposite end walls;

a pivot member rotatably mounted in the housing and extending transverse to the outer wall of the housing and the side surface of the trash container in a direction away from the side surface of the trash container, the pivot member having an outer end portion which projects through the outer wall of the housing;

a swing arm having an end secured to the projecting outer end portion of the pivot member at a location outside the housing, the swing arm and extending in a direction transverse to the pivot member;

a lock bar secured to the swing arm and extending in a direction parallel to the pivot member, the lock bar configured to move on rotation of the pivot member and swing arm between an operative position in which the lock bar extends over at least one closed lid of a trash container and an inoperative position in which the lock bar is rotated in front of the container to release the lid;

first and second latch members inside the housing which have interengaging formations configured to engage in a latched position to prevent rotation of the pivot member and attached swing arm and movement of the lock bar into the inoperative position;

the first latch member being secured to the pivot member inside the housing and the second latch member pivotally associated with the housing for rotation relative to the housing between a first, latch-ready position and a second, latch-released position, the second latch member rotating under gravity between the first and second positions to release the first latch member automatically when the trash container is inverted to dump trash from the container;

a manually operable cam member movably mounted in the housing which engages the second latch member and rotates it into the second position to release the first latch member when actuated by a user; and a manually operable locking device which locks the cam member in a fixed, inoperative position to restrict manual release of the latch by an unauthorized user.

2. A trash container locking apparatus comprising:

a housing which is secured to a surface of a trash container;

a pivot member rotatably mounted in the housing and having an outer portion which extends out of the housing;

a swing arm secured to the outer portion of the pivot member;

a lock bar associated with the swing arm and configured to move on rotation of the pivot member and movable between an operative position in which the lock bar extends over at least one closed lid of a trash container and an inoperative position in which the lock bar is rotated in front of the container to release the lid;

first and second latch members inside the housing which have interengaging formations configured to engage in a latched position to prevent rotation of the pivot member and attached swing arm and movement of the lock bar into the inoperative position;

the first latch member being secured to the pivot member inside the housing and the second latch member pivotally associated with the housing for rotation relative to the housing between a first, latch-ready position and a second, latch-released position, the second latch member rotating under gravity between the first and second positions to release the first latch member automatically when the trash container is inverted to dump trash from the container;

a keyed lock mechanism which locks the second latch member in the first position when the trash container is in an upright condition to restrict manual release of the latch by an unauthorized user, the keyed lock mechanism having a key cylinder that extends inside the housing, a cam member secured to the key cylinder inside the housing, and a key configured to engage the key cylinder and to be rotated by the user between locked and unlocked positions;

the key being configured to rotate the key cylinder and attached cam member between corresponding locked and unlocked positions on rotation of the key by the user between the locked and the unlocked position, and the cam member being configured to engage the second latch member on rotation between the locked and unlocked position and to rotate the second latch member into the second position, whereby rotation of the key directly operates the cam member to release the first latch member.

3. The apparatus of claim 1, wherein the manually operable locking device comprises a pivotally mounted operating lever which extends outside the housing and has an opening which engages a padlock securing the operating lever to a fixed part of the housing, the operating lever being secured to the cam member inside the housing whereby the operating lever can be manually activated to move the cam member into the second position when the padlock is released.

4. The apparatus of claim 3, wherein the cam member is substantially curved in the direction of the second latch member so that when the operating lever is manually rotated it rotates the second latch member between the first and second positions to release the first latch member.

5. The apparatus of claim 3, further comprising a fixed locking flange on the outside of the housing, the fixed locking flange having an opening aligned with the opening in the operating lever to receive the hasp of a padlock extending through the openings in the locked position.

6. The apparatus of claim 2, wherein the first latch member extends radially from the pivot member.

7. The apparatus of claim 2, wherein the second latch member comprises a paddle having a first end pivotally mounted inside the housing and a second free end, the paddle hanging vertically facing the first latch member when the trash container is upright and the cam member is locked in the inoperative position.

8. The apparatus of claim 7, wherein the paddle has an opening and the first latch member has a hooked end engaging through the opening in the latched position, the opening and hooked end comprising the interengaging formations.

9. The apparatus of claim 7, wherein the paddle has an upper end position aligned with the first latch member in the latched position and a lower end portion facing the cam member which is engaged by the cam member for rotation away from the first latch member into the second position for manual release of the latch.

10. The apparatus of claim 7, wherein the paddle rotates away from the first latch member under gravity when the container is inverted.

11. The apparatus of claim 7, wherein the paddle and first latch member are oriented perpendicular to one another.

12. The apparatus of claim 2, wherein the swing arm is secured to the outer portion of the pivot member at a location spaced outward from the outer wall of the housing, and the swing arm rotates in a plane parallel to the housing outer wall.

13. The apparatus of claim 2, wherein the pivot member comprises a pivot pin rotatably mounted in the outer wall of the housing with a first end located inside the housing and a second end located outside the housing, the swing arm has a first end secured to the second end of the pivot pin and a second end secured to the lock bar, and the first latch member is secured to the pivot pin inside the housing at a location spaced from the outer wall.

* * * * *